US006348081B1

(12) United States Patent
Horata et al.

(10) Patent No.: US 6,348,081 B1
(45) Date of Patent: Feb. 19, 2002

(54) GRANULATED POWDER FOR HIGH-DENSITY SINTERED BODY, METHOD FOR PRODUCING HIGH-DENSITY SINTERED BODY USING THE SAME, AND HIGH-DENSITY SINTERED BODY

(75) Inventors: Akira Horata, Gamagori; Tetsuya Kondo, Nagoya, both of (JP)

(73) Assignee: Daido Tokushuko Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/668,931

(22) Filed: Sep. 25, 2000

(30) Foreign Application Priority Data

Sep. 29, 1999 (JP) ..... 11-275923

(51) Int. Cl.[7] ..... C22C 33/02; B22F 9/02; B22F 3/12

(52) U.S. Cl. ..... 75/246; 75/255; 419/30; 419/38

(58) Field of Search ..... 75/246, 255; 419/38, 419/30

(56) References Cited

U.S. PATENT DOCUMENTS 5,756,909 A * 5/1998 Liimatainen et al. ..... 75/238

5,841,041 A * 11/1998 Asano et al. ..... 75/229

FOREIGN PATENT DOCUMENTS

| | | |
|---|---|---|
| JP | 63-293102 | 11/1988 |
| JP | 2-166201 | 6/1990 |
| JP | 7-90301 | 4/1995 |

* cited by examiner

*Primary Examiner*—Ngoclan Mai
(74) *Attorney, Agent, or Firm*—Frishauf, Holtz, Goodman, Langer & Chick, P.C.

(57) ABSTRACT

A granulated powder for a high-density sintered body is provided, which has an excellent flow rate and an excellent sintered density, and a sintered body produced using the same is provided. The granulated powder is obtained by granulation using a binder and a powder material comprising small diameter particles comprised of stainless steel and having an average particle diameter of 1 to 20 $\mu$m and large diameter particles comprised of stainless steel and having an average particle diameter of 30 to 150 $\mu$m. The content of the small diameter particles in the granulated powder is 30 to 70% by weight, and at least part of the small diameter particles adheres to the surfaces of the large diameter particles to form skin particles.

9 Claims, 3 Drawing Sheets

25 μm

—·—· PRESSURE DURING PRESSING OF POWDER; 6ton/cm²
—— PRESSURE DURING PRESSING OF POWDER; 7ton/cm²

GRANULATED POWDER FOR HIGH-DENSITY SINTERED BODY, METHOD FOR PRODUCING HIGH-DENSITY SINTERED BODY USING THE SAME, AND HIGH-DENSITY SINTERED BODY

BACKGROUND OF THE INVENTION

1. Field of the Invention

The present invention relates to a granulated powder for use in the powder metallurgy production of a high-density sintered body, a method for producing a high-density sintered body using the granulated powder, and the high-density sintered body produced.

2. Prior Art

Exhaust pipes of automobiles are generally provided with a catalyst device, a mounting boss for an oxygen sensor and the like, which are arranged thereon. Such an exhaust pipe is comprised of, for example, a front pipe, a mounting boss for an oxygen sensor, a catalyst device, and a center pipe which are connected in this order as seen from the exhaust manifold, and the rear end of the center pipe is connected with the muffler. In this arrangement, the front and center pipes are connected with the mounting boss, the catalyst device and the like through flanges that are respectively welded to the front and rear ends of the front and center pipes. Conventionally, these flanges and the mounting boss have been produced by processing ingot materials. Since they have complicated shapes, the processing cost increases, bringing the cost up.

For this reason, these component parts have been produced at lower cost by sintering powder comprised of the same material (e.g., ferrite stainless steel) as that used for the exhaust pipe. That is, a sintered body is produced by a method in which a green compact obtained by pressing a predetermined metal powder charged into a die is sintered at a temperature equal to or higher than the sintering temperature of the metal powder.

With the recent progress of high performance and high efficient engines, the exhaust gas temperature of an engine tends to become higher. Therefore, austenite stainless steel (SUS304, etc.), having excellent heat resistance as compared to that of ferrite stainless steel and having corrosion resistance to the corrosive exhaust gas, is used as a constituent material for the exhaust pipe. When the exhaust pipe comprised of austenite stainless steel is welded to the flange comprised of ferrite stainless steel, however, thermal fatigue properties of the resultant welded article are lowered due to the difference in coefficient of thermal expansion between the constituent materials. This indicates that the flanges and the mounting bosses must be produced by sintering powder of the same material (austenite stainless steel) as that for the exhaust pipe to be welded thereto.

However, the following problems arise when the powders of ferrite stainless steel and austenite stainless steel are sintered.

First, the sintered density (hermetic property) of the resultant sintered body is not high enough. Since component parts of the exhaust system of automobiles require a high hermetic property, such a problem is inconvenient and must be solved. To improve the hermetic property of the sintered body, pores (open pores), in particular, which are present in the sintered body and open to an outer surface thereof, must be reduced. Although the open porosity of the sintered body of stainless steel, constituting the exhaust system parts, must be less than 5% no sintered body having such an excellent hermetic property has been obtained.

The just-mentioned problem becomes remarkable especially when the powder of austenite stainless steel or ferrite stainless steel such as 13Cr-2Al or SUS430J1L is sintered. As for the austenite stainless steel, the diffusion coefficient of Fe contained in the austenite is smaller than that of Fe contained in the ferrite, and the sintering reaction is difficult to proceed, so that the hermetic property of the resultant sintered body is likely to lower. In the case of the ferrite stainless steel powder containing the above-mentioned constituents, the sintering reaction is also difficult to proceed.

Secondly, the green strength of a green compact obtained by compressing the powder prior to the sintering is not adequate, and a crack or breakage is likely to occur, resulting in a tendency that the yield of the final products is lowered. It has been generally known that the powder which is low in flow rate (fluidity) does not uniformly flow in the die during the pressuring, so that the uniformity of the green density (packing density of the powder) is lowered, leading to a low strength of the green compact.

As a countermeasure against the second problem, Japanese Unexamined Patent Publication Nos. 63-293102 and 2-166201, for example, disclose a technique of charging a mixed powder of coarse and fine particles into a die to allow the fine particles to be disposed in spaces between the coarse particles, thus improving the green density. Further, Japanese Unexamined Patent Publication No. 7-90301 discloses a technique of producing granulated powder having an excellent flow rate by combining a main component with a subsidiary component, to thereby improve the green density.

However, as explained above, the stainless steel powder, especially the powder of austenite stainless steel or ferrite stainless steel such as 13Cr-2Al or SUS430J1L, has a tendency that the sintering reaction is difficult to proceed. Therefore, even when the green density during the pressing of powder is increased by employing the conventional technique, the sintered density (hermetic property) of the sintered body cannot be satisfactorily improved.

OBJECTS AND SUMMARY OF THE INVENTION

It is an object of the present invention to solve the above-described problems during the sintering of stainless steel powder, and to provide a granulated powder for a high-density sintered body, which powder has an excellent flow rate (fluidity) in the die during the production of a green compact, so that the resultant green compact has an excellent green strength, making it possible to improve the sintered density (hermetic property) of the sintered body.

It is another object of the present invention to provide a method for producing a high-density sintered body using the above-mentioned granulated powder, and a high-density sintered body produced by this method.

To attain the object, the present invention provides granulated powder for a high-density sintered body, which powder is obtained by granulation using a binder and a powder that includes small diameter particles comprised of stainless steel and having an average particle diameter of 1 to 20 $\mu$m and large diameter particles comprised of stainless steel and having an average particle diameter of 30 to 150 $\mu$m, wherein the content of the small diameter particles in the granulated powder is 30 to 70% by weight, and at least part of the small diameter particles adheres to the surfaces of the large diameter particles.

Preferably, the binder has a lubricating property, and the granulated powder has a flow rate of 15 sec/50 g or less as measured by the determination of flow rate (the fluidity test) employing an orifice diameter of 5 mm in accordance with JIS Z2504.

Further, the present invention provides:

a method for producing a high-density sintered body, comprising the steps of:

producing a green compact using the aforementioned granulated powder; and sintering the green compact at a temperature of 1100 to 1350° C.

Further, the present invention provides:

a high-density sintered body which is a sintered body of the above-mentioned granulated powder and has an open porosity of 5% or less.

DETAILED DESCRIPTION OF THE INVENTION

The present invention has been achieved based on a recognition that the smaller the particle diameter of the powder, the higher the sintered density. Specifically, a powder to be sintered contains small diameter particles in a predetermined ratio or more. It is known that, when the content of the small diameter particles in the powder is too large, the small diameter particles agglomerate together to form irregular coarse particles having a large surface unevenness and a poor flow rate, so that the flow rate of the whole of the material powder is lowered and hence the strength of the green compact is lowered.

In view of the above, the present invention uses a powder having an excellent flow rate, which powder is obtained by allowing part of the small diameter particles to adhere to large diameter particles, to thereby prevent the flow rate of the whole of the powder from being lowered. Specifically, the present invention provides a technical concept of using small diameter particles in a manner increasing the sintered density of the sintered body and at the same time solving the problem of lowering of the flow rate which is a drawback caused by the usage of small diameter particles.

In the following, a granulated powder 1 for a high-density sintered body according to the present invention is described with reference to FIG. 1. The granulated powder 1 is produced by subjecting a mixture of a fine powder and a coarse powder to granulation. The fine powder mainly contains small diameter particles 2, and the coarse powder contains large diameter particles 4 and small diameter particles 2 in a predetermined ratio and has a certain particle size distribution. By appropriately adjusting the mixing ratio of the fine powder to the coarse powder, the content of small diameter particles 2 in the granulated powder 1 is determined. The granulated powder 1 is then charged into a die and pressed, thereby preparing a green compact. Next, the green compact is sintered to produce a sintered body which is a final product.

In addition to the small diameter particles 2 and large diameter particles 4, the granulated powder 1 appropriately contains particles having various particle diameters. FIG. 1 diagrammatically shows the representative particles contained in the granulated powder 1.

Figure 1:
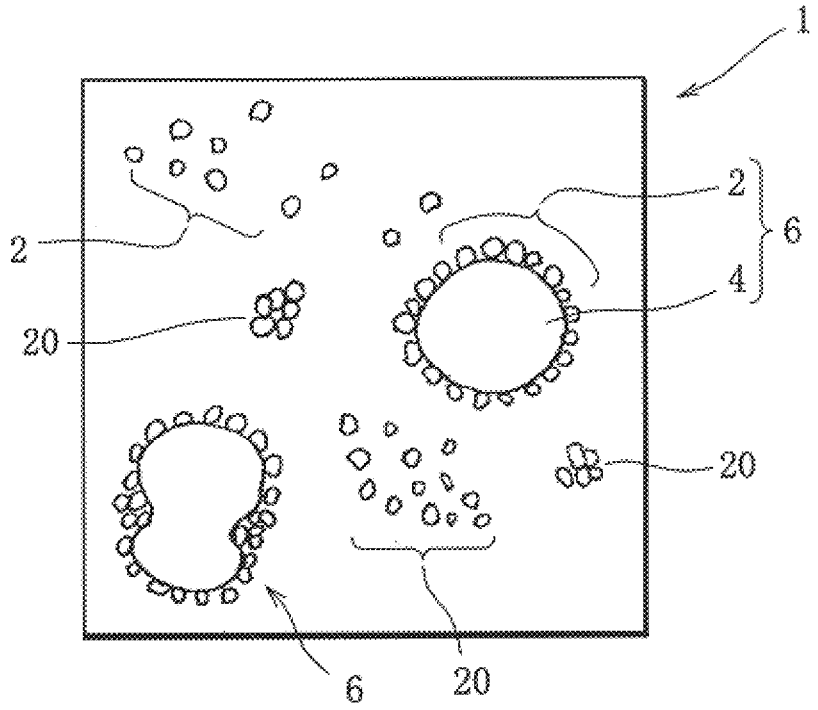
FIG. 1 is a diagram showing a granulated powder for a high-density sintered body according to the present invention.

In FIG. 1, the small diameter particles 2 and the large diameter particles 4 are contained in the granulated powder 1, and part of the small diameter particles 2 adheres to the surfaces of large diameter particles 4 through a binder, to thereby form particles (hereinafter, referred to as "skin particles") 6 to which the small diameter particles adhere. Further, a portion of the remaining small diameter particles 2 is present in isolation, and the remainder appropriately agglomerates together to be present as agglomerate particles 20 each having a medium particle diameter.

The small diameter particles 2 comprised of stainless steel are densely disposed between the above-mentioned particles, due to their small particle diameters, without forming spaces therebetween during the pressing of powder. In this state, sintering readily takes place, so that the sintered density of the resultant sintered body is improved. Specifically, the sintering reaction between the particles is promoted, since the sintering reaction generally proceeds due to the growth and connection of particles at their contact points and the contact areas between particle per unit volume becomes larger as the particle diameter becomes smaller. Especially in the case of an austenite stainless steel powder wherein the diffusion coefficient of Fe is small and the sintering is difficult to take place, the use of such small diameter particles produces remarkable effects in realizing the promotion of sintering.

From this point of view, it is necessary to use small diameter particles 2 having an average particle diameter of 1 to 20 $\mu$m. The average particle diameter used here means a 50% particle diameter (median diameter). A smaller average particle diameter is preferable in obtaining a higher sintered density of the sintered body and in reducing the open porosity. However, when the average particle diameter is too small, the production cost increases and there is a possibility that the granulation operation is difficult to perform. For this reason, the average particle diameter should be 1 $\mu$m or more. On the other hand, when the average particle diameter exceeds 20 $\mu$m, the contact areas between the particles during the sintering are reduced, so that the sintering reaction is difficult to proceed. Therefore, the average particle diameter should be 20 $\mu$m or less. A preferred average particle diameter is in the rage from 5 to 15 $\mu$m.

Further, it is necessary that the content of small diameter particles 2 in the granulated powder be 30 to 70% by weight. When the content of the small diameter particles is less than 30% by weight, the effect of promoting the sintering reaction is unsatisfactory. On the other hand, when the content exceeds 70% by weight, the above-mentioned irregular coarse particles are likely to be formed. It is preferred that the content is in the range from 30 to 50% by weight.

Figure 2:
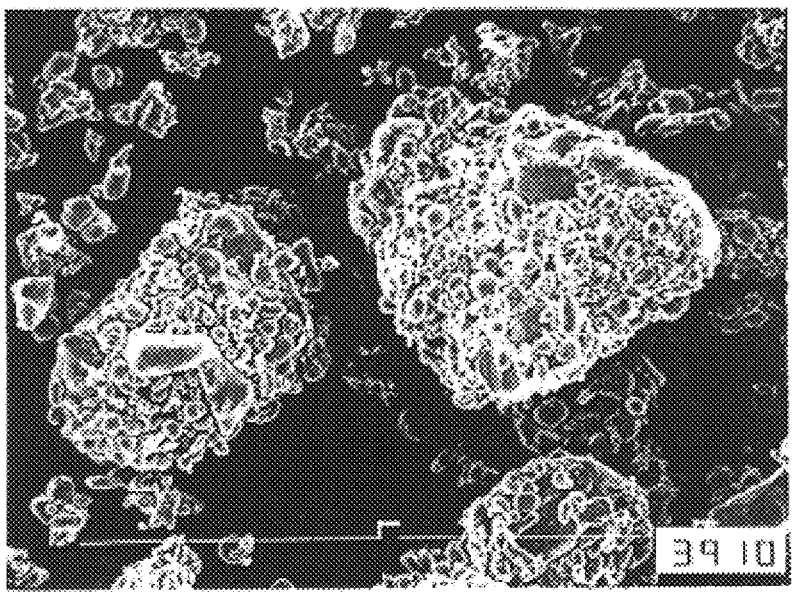
FIG. 2 is a photograph showing a scanning electron microscope (SEM) photomicrograph of a granulated powder for a high-density sintered body according to the present invention.

The large diameter particles 4 are comprised of stainless steel having substantially the same composition as that of the small diameter particles. During the granulation, the small diameter particles 2 are allowed to adhere to the surfaces of the large diameter particles, to thereby form the skin particles 6. As specifically shown in FIG. 2, the surfaces of these skin particles 6 are covered with the small diameter particles, so that the surfaces are relatively smooth. That is, the skin particles 6 exhibit a high flow rate, and thus, the flow rate or fluidity of the granulated powder in its entirety is improved.

From this point of view, it is necessary to use the large diameter particles 4 having an average particle diameter of 30 to 150 $\mu$m. When the average particle diameter is less than 30 $\mu$m, the flow rate of the skin particles basically formed of the large diameter particles is not high enough, so that the flow rate of the granulated powder is not improved. On the other hand, when the average particle diameter exceeds 150 $\mu$m, spaces are generated between the large diameter particles (skin particles) during the sintering and the contact areas therebetween are reduced, so that the sintering reaction is difficult to proceed. Preferably, the average particle diameter is in the range from 40 to 100 $\mu$m. To be noted, the average particle diameter mentioned here is defined in the same manner as in the case of the small diameter particles.

Preferably, the large diameter particles 4 are present in the amount of 30 to 70% by weight to the total weight of the granulated powder 1. When the content of the large diameter particles is less than 30% by weight, the amount of the skin particles formed is small, so that the effect of improving the flow rate of the granulated powder is unsatisfactory. When the content exceeds 70% by weight, spaces are generated between the large diameter particles (skin particles) during the sintering, so that the sintering reaction is difficult to proceed.

In the production of the small diameter particles 2 and large diameter particles 4, ferrite stainless steel and austenite stainless steel can be used.

By way of example, the austenite stainless steel may have a composition such that C is 0.15% by weight or less, Si is 3% by weight or less, Mn is 2% by weight or less, Ni is 6% by weight or more, Cr is 12 to 26% by weight, Mo is 5% by weight or less, and the remainder is Fe. In addition to these components, Cu, Nb, or Sn may be added, for instance.

The reason why the C content is 0.15% by weight or less resides in that, when the C content exceeds 0.15% by weight, the powder is hardened, leading to lowering of the green density, and there is a possibility that the corrosion resistance of the resultant sintered body will be markedly deteriorated. It is more preferred that the C content is 0.10% by weight or less.

The reason why the Si content is 3% by weight or less resides in that, when the Si content exceeds 3% by weight, the powder is hardened, leading to lowering of the green density, and thus, there is a possibility that the compactibility becomes poor. It is more preferred that the Si content is 1.5% by weight or less.

The Mn content is 2% by weight or less. When the Mn content exceeds 2% by weight, the oxygen content of the powder becomes large, so that there is a possibility that the compactibility during the pressing of powder becomes poor. It is more preferred that the Mn content is 0.5% by weight or less.

The reason why the Ni content is 6% by weight or more resides in that, when the Ni content is less than 6% by weight, the powder is hardened by the formation of martensite, so that there is a possibility that green density is markedly lowered.

The Cr content is 12 to 26% by weight. When the Cr content is less than 12% by weight, a satisfactory corrosion resistance cannot be obtained. On the other hand, when the Cr content exceeds 26% by weight, the powder is hardened, so that there is a possibility that the green density is lowered and the elongation becomes small. It is more preferred that the Cr content is 16 to 20% by weight.

The reason why the Mo content is 5% by weight or less resides in that, when the Mo content exceeds 5% by weight, the powder is hardened, so that there is a possibility that the compactibility becomes poor.

Examples of austenite stainless steel having the above-described compositions include SUS304, SUS316, SUS310S, SUS317 and the like.

The ferrite stainless steel to be used in the present invention includes 13Cr-2Al and SUS430J1L, for instance.

For the production of the above-mentioned fine powder and coarse powder containing the small diameter particles 2 and the large diameter particles 4, conventionally known methods such as a water atomizing method, a gas atomizing method and the like can be applied. The thus obtained fine powder and coarse powder may be appropriately classified and used as material powders for the production of granulated powder.

In the granulation, the fine powder mainly containing the small diameter particles 2 is mixed, using a binder, with the coarse powder containing the small diameter particles 2 and the large diameter particles 4 in a predetermined ratio to thereby produce the granulated powder 1 of the present invention. Examples of the binder to be used include zinc stearate, lithium stearate, calcium stearate, ethylenebisstearamide, polyvinyl alcohol, methyl cellulose, an ethylene-vinyl copolymer, an ethylene-methacrylate copolymer and the like. The binder may be added in, for example, a mixing ratio of 0.8 to 2.5 parts by weight to 100 parts by weight of the granulated powder.

By using a binder having a lubricating property, the flow rate of the resultant granulated powder is advantageously improved. Examples of such a binder having a lubricating property include zinc stearate, lithium stearate, calcium stearate, ethylenebisstearamide, which can be used singly or by mixing appropriately.

It is preferred that the flow rate of the thus obtained granulated powder 1 is 15 sec/50 g or less as measured by the determination of flow rate employing an orifice diameter of 5 mm in accordance with JIS Z2504. When the flow rate of the granulated powder falls in this range, the powder uniformly flows in the die during the pressing of powder, so that the strength of the green compact becomes high and the lowering of the yield of products due to the occurrence of crack and breakage is prevented.

Next, a method for producing a sintered body using the above-mentioned granulated powder 1 is described.

First, the granulated powder is charged into a die having an internal space which is substantially the same in shape as the final product. Then, the powder is subjected to compression pressing by pressing at a pressure of about 3 to 10 tons/cm$^2$ by means of, for example, an upper punch, to thereby prepare a green compact.

Next, the green compact taken out from the die is sintered in vacuum or in an atmosphere of hydrogen gas, ammonia decomposed gas or the like at a temperature ranging from 1100 to 1350° C. for 15 to 120 minutes, to thereby produce a sintered body. When the temperature in the sintering is lower than 1100° C., there is a possibility that the sintering does not satisfactorily proceed. On the other hand, when the temperature is higher than 1350° C., the shrinkage markedly occurs during the sintering, so that there is a possibility that the dimensional accuracy of the products becomes poor. It is more preferred that the sintering temperature is 1200 to 1300° C.

The thus produced high-density sintered body of the present invention is comprised of stainless steel, and has an open porosity of 5% or less. Therefore, the sintered body can be advantageously used in the applications that require an excellent hermetic property, such as component parts of the exhaust system of automobiles. The open porosity used here means the intercommunicating porosity prescribed in JIS Z2506. That is, it indicates a ratio of the volume of those pores (permeable pores) which extend from the inside of the sintered body to the surface thereof, among all the pores formed in the sintered body, to the volume of the sintered body.

By sintering the above-mentioned granulated powder at the aforementioned sintering temperature, it is possible to increase the strength of the green compact during the pressing of powder and improve the sintered density during the sintering, so that a sintered body having an open porosity of 5% or less can be obtained.

When the open porosity of the sintered body is 5% or less, it is also possible to suppress an occurrence of crevice corrosion due to the presence of pores and the like, so that the corrosion resistance of the sintered body is improved, and thus, the sintered body exhibits a corrosion resistance as high as the corrosion resistance of the constituent material (stainless steel) per se.

Since the sintered body of the present invention is produced by sintering a material powder comprised of small diameter particles, the sintered density is as high as 89 to 98% and the strength and ductility are also excellent.

EXAMPLES 1 to 6 AND COMPARATIVE EXAMPLES 1 AND 2

1. Production of Granulated Powder

Coarse powder (DAP304L) b comprising large diameter particles 4 and small diameter particles 2 in the proportion shown in Table 1, and fine powders $a_1$ to $a_6$ respectively comprising small diameter particles 2 having average particle diameters shown in Table 2 were prepared. Then, coarse powder b was mixed with each of fine powders $a_1$ to $a_6$ in a weight ratio of 1:1. About 1 to 2 parts by weight of a binder were added to 100 parts by weight of each of the resultant mixed powders, and the resultant mixture was subject to granulation, to thereby obtain granulated powders $A_1$ to $A_6$. As the binder, an ethylenebisstearamide (EBS) lubricant (MX-731A; manufactured by Adeca Fine Chemical Co., Ltd.) was used. The chemical compositions of coarse powder b and fine powders $a_1$ to $a_6$ are shown in Table 3.

About 30% by weight or less of coarse powder b has a particle size of 30 μm or less and contains fine particles having the same diameters of those of fine powders $a_1$ to $a_6$. When a fine powder containing substantially 100% small diameter particles is mixed with the just-mentioned coarse powder b, 50% of the resultant granulated powder is comprised of the fine powder, and thus, the amount of the fine particles contained in the coarse powder b can be neglected. In the following Examples, the content of the small diameter particles in the granulated powder is regarded as 50% by weight.

With respect to each of granulated powders $A_1$ to $A_6$, an apparent density was measured by the conventional method, and a flow rate was measured and evaluated by the determination of flow rate employing an orifice diameter of 5 mm in accordance with JIS Z2504. These values are shown in Table 4.

As a comparison, a granulated powder was produced in the same manner as in Examples 1 to 6 except that the average particle diameter of the small diameter particles was 22.3 μm. This is taken as Comparative Example 1. Further, Comparative Example 2 was obtained by mixing small diameter particles having an average particle diameter of 10.3 μm with the large diameter particles, without subjecting the small and large diameter particles to granulation.

TABLE 1

| | Content of large diameter particles (wt %) | Content of particles having particle size of 30 μm or less (wt %) |
|---|---|---|
| Coarse powder b | 41 | 59 |

TABLE 2

| | Average particle diameter (μm) |
|---|---|
| Fine powder $a_1$ | 8.0 |
| Fine powder $a_2$ | 11.0 |
| Fine powder $a_3$ | 15.5 |
| Fine powder $a_4$ | 17.1 |
| Fine powder $a_5$ | 3.0 |
| Fine powder $a_6$ | 5.0 |

TABLE 3

| | C (wt %) | Si | Mn | P | S | Cu | Ni | Cr | Mo | N | O |
|---|---|---|---|---|---|---|---|---|---|---|---|
| Coarse powder b | 0.013 | 0.87 | 0.24 | 0.023 | 0.004 | 0.05 | 11.06 | 18.60 | 0.04 | 0.057 | 0.20 |
| Fine powder $a_1$~$a_6$ | — | 0.85 | 0.14 | 0.017 | 0.004 | — | 10.80 | 18.47 | — | — | — |

TABLE 4

| | | Small diameter particles in granulated powder | | Characteristics of granulated powder | |
|---|---|---|---|---|---|
| | Type of granulated powder | Average particle diameter (μm) | Content (wt %) | Apparent density (g/cm³) | Flow rate (sec/50 g) |
| Example 1 | $A_1$ | 8.0 | About 50 | 2.61 | 9.2 |
| Example 2 | $A_2$ | 11.0 | About 50 | 2.83 | 9.2 |
| Example 3 | $A_3$ | 15.5 | About 50 | 2.87 | 9.3 |
| Example 4 | $A_4$ | 17.1 | About 50 | 2.88 | 9.0 |
| Example 5 | $A_5$ | 3.0 | About 50 | 2.51 | 10.7 |

TABLE 4-continued

| | Type of granulated powder | Small diameter particles in granulated powder: Average particle diameter (μm) | Small diameter particles in granulated powder: Content (wt %) | Characteristics of granulated powder: Apparent density (g/cm³) | Characteristics of granulated powder: Flow rate (sec/50 g) |
|---|---|---|---|---|---|
| Example 6 | $A_6$ | 5.0 | About 50 | 2.57 | 9.9 |
| Comparative Example 1 | — | 22.3 | About 50 | 2.79 | 8.8 |
| Comparative Example 2 | Not granulated | 10.3 | About 50 | 2.47 | Not flow |

2. Evaluation of Properties of Green Compact

Each of granulated powders $A_1$ to $A_6$ was charged into a predetermined die and pressed at an applied pressure of 8 tons/cm$^2$, to thereby prepare a green compact in a cylinder form (11 mm ϕ). With respect to each of the green compacts, strength was evaluated by the rattler test in accordance with JSPM Standard 4-69, and a green density was measured. The rattler test value indicates the weight reduction ratio of the test piece before and after the test. The smaller the rattler value, the more excellent the green strength.

3. Evaluation of Properties of Sintered Body

Each of the above-mentioned green compacts was taken out from the die, and subjected to debinder (dewaxing) treatment by heating in air at 400° C. for 30 minutes, followed by sintering in vacuum at 1250° C. for 60 minutes. With respect to each of the sintered bodies, a sintered density was measured, and an open porosity was measured and evaluated by the determination of intercommunicating porosity in accordance with JIS Z2506. The smaller the open porosity value, the more excellent the hermetic property of the sintered body. The results of these evaluations are shown in Table 5 and FIG. 3.

TABLE 5

| | Evaluation of properties of green compact: Rattler value (%) | Evaluation of properties of green compact: Green density (g/cm³) | Evaluation of properties of sintered body: Sintered density (g/cm³) | Evaluation of properties of sintered body: Open porosity (%) |
|---|---|---|---|---|
| Example 1 | 3.85 | 6.64 | 7.44 | 0.13 |
| Example 2 | 3.47 | 6.68 | 7.36 | 0.06 |
| Example 3 | 2.57 | 6.65 | 7.23 | 1.82 |
| Example 4 | 2.40 | 6.63 | 7.15 | 3.68 |
| Example 5 | 4.03 | 6.58 | 7.51 | 0.02 |
| Example 6 | 4.15 | 6.61 | 7.48 | 0.02 |
| Comparative Example 1 | 2.23 | 6.62 | 6.96 | 8.64 |

TABLE 5-continued

| | Evaluation of properties of green compact: Rattler value (%) | Evaluation of properties of green compact: Green density (g/cm³) | Evaluation of properties of sintered body: Sintered density (g/cm³) | Evaluation of properties of sintered body: Open porosity (%) |
|---|---|---|---|---|
| Comparative Example 2 | 43.01 | 6.28 | 6.96 | 6.87 |

Figure 3:
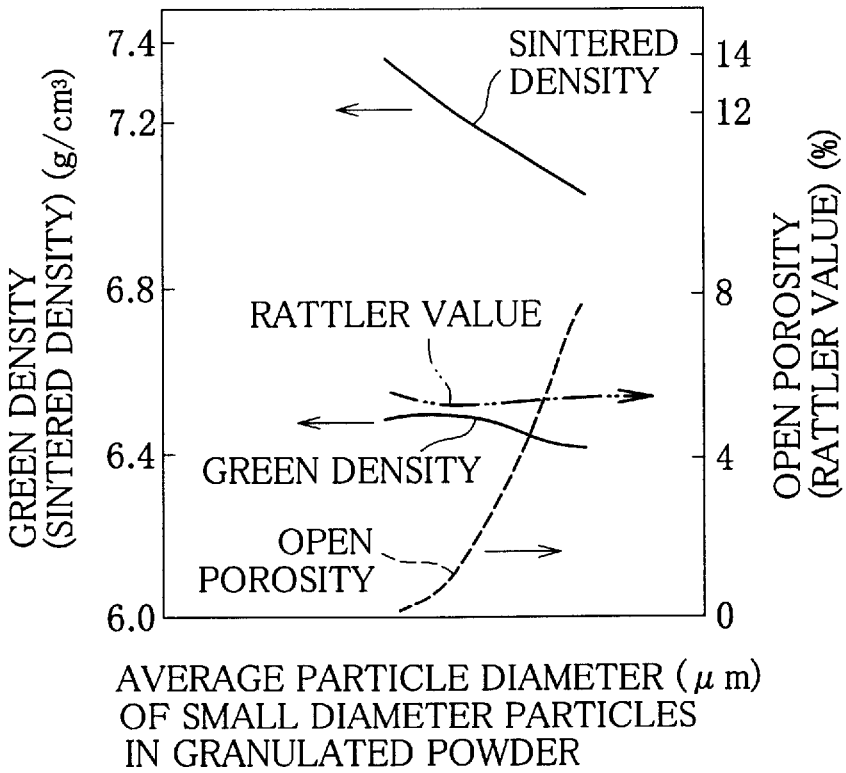
FIG. 3 is a graph in which the particle diameter of small diameter particles in the granulated powder is taken as the abscissa, and the green density, rattler value, sintered density and open porosity of the sintered body are individually taken as the ordinate.

As is apparent from Table 5 and FIG. 3, in the granulated powders in Examples 1 to 6, the flow rate is high and the green density during the pressing of powder is excellent. Further, the sintered density during the sintering is excellent and the open porosity of the sintered body is small. There is a tendency that the open porosity becomes smaller and the sintered density and the green density become larger, as the average particle diameter of the small diameter particles becomes smaller.

In Comparative Example 1 wherein the average particle diameter of the small diameter particles is larger than those of the granulated powders in Examples 1 to 6, the open porosity of the sintered body increases as the sintered density decreases. Therefore, it is necessary that the average particle diameter of the small diameter particles be 20 μm or less.

In Comparative Example 2 wherein the small diameter particles and the large diameter particles were merely mixed with each other without granulation, the flowability was poor and the density of the green compact was low, so that the open porosity of the resultant sintered body was increased.

EXAMPLES 7 to 11 AND COMPARATIVE EXAMPLES 3 TO 5

1. Production of Granulated Powder

Fine powder c comprising small diameter particles having an average particle diameter of 8 μm, and the same coarse powder b as that in Examples 1 to 6 were prepared. Then, coarse powder b was mixed with fine powder c in predetermined weight ratios, and to 100 parts by weight of each of the resultant mixed powders was added about 1 to 2.7 parts by weight of a binder. The resultant mixture was subject to granulation, to obtain granulated powders $B_7$ to $B_{11}$ respectively containing the small diameter particles in the contents shown in Table 7. The same binder as that used in Examples 1 to 6 was used. The chemical composition of fine powder c is shown in Table 6.

With respect to each of granulated powders $B_7$ to $B_{11}$, an apparent density and a flow rate were measured in the same manner as in Examples 1 to 6. These values are shown in Table 7.

As a comparison, granulated powders were produced in the same manner as in Examples 7 to 11 except that the contents of the small diameter particles in the granulated powder were 0, 20 and 80% by weight, respectively. These are respectively taken as Comparative Examples 3 to 5.

TABLE 6

| | C (wt %) | Si | Mn | P | S | Cu | Ni | Cr | Mo | N | O |
|---|---|---|---|---|---|---|---|---|---|---|---|
| Fine powder c | 0.016 | 0.88 | 0.14 | 0.021 | 0.004 | — | 10.84 | 18.75 | — | 0.098 | 0.30 |

TABLE 7

| | Type of granulated powder | Small diameter particles in granulated powder: Average particle diameter (μm) | Small diameter particles in granulated powder: Content (wt %) | Characteristics of granulated powder: Apparent density (g/cm³) | Characteristics of granulated powder: Flow rate (sec/50 g) |
|---|---|---|---|---|---|
| Example 7 | $B_7$ | 8 | 30 | 2.88 | 7.4 |
| Example 8 | $B_8$ | 8 | 40 | 2.80 | 8.2 |
| Example 9 | $B_9$ | 8 | 50 | 2.61 | 9.2 |
| Example 10 | $B_{10}$ | 8 | 60 | 2.68 | 10.4 |
| Example 11 | $B_{11}$ | 8 | 70 | 2.37 | 9.6 |
| Comparative Example 3 | — | 8 | 0 | 2.66 | 8.2 |
| Comparative Example 4 | — | 8 | 20 | 2.90 | 7.5 |
| Comparative Example 5 | — | 8 | 80 | 2.29 | 13.9 |

2. Evaluation of Properties of Green Compact

Green compacts were prepared from granulated powders $B_7$ to $B_{11}$ in the same manner as in Examples 1 to 6. The applied pressure was 6 tons/cm$^2$ and 7 tons/cm$^2$. Then, with respect to each of the green compacts, a green density and a rattler test value were evaluated.

Figure 4:
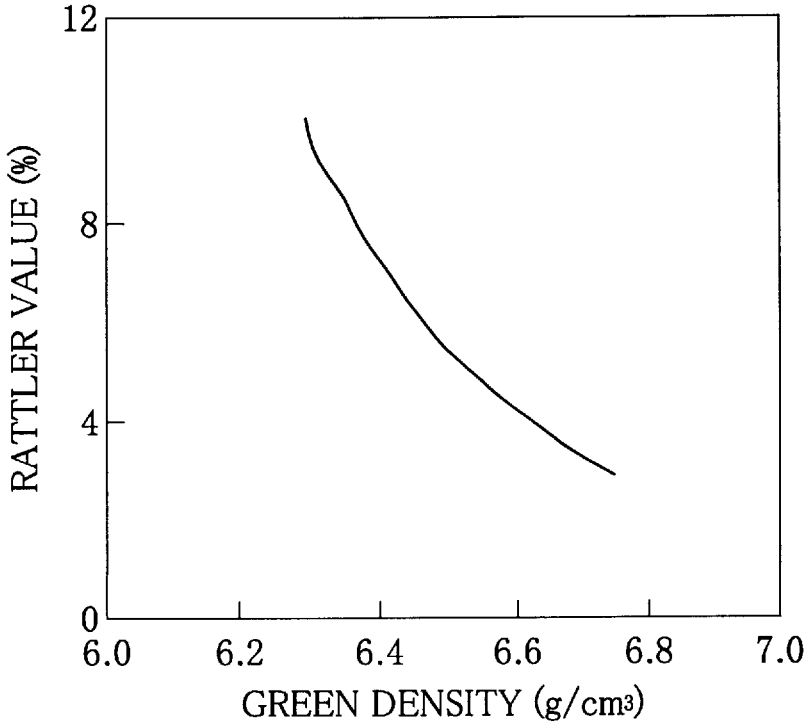
FIG. 4 is a graph showing the relationship between the green density and the rattler value when the content of the small diameter particles in the granulated powder is 50% by weight.

As shown in FIG. 4, a correlation is observed between the rattler value and the green density.

3. Evaluation of Properties of Sintered Body

Each of the above-mentioned green compacts was taken out from the die, and sintered in the same manner as in Examples 1 to 6. With respect to each of the resultant sintered bodies, a sintered density and an open porosity were measured and evaluated. The results of these evaluations are shown in Table 8 and FIG. 5.

TABLE 8

| | Evaluation of properties of green compact: Rattler value (%) | Evaluation of properties of green compact: Green density (g/cm³) | Evaluation of properties of sintered body: Sintered density (g/cm³) | Evaluation of properties of sintered body: Open porosity (%) |
|---|---|---|---|---|
| Example 7 | 4.65 | 6.59 | 7.21 | 2.67 |
| Example 8 | 5.48 | 6.56 | 7.28 | 0.23 |
| Example 9 | 5.69 | 6.49 | 7.35 | 0.03 |
| Example 10 | 6.87 | 6.41 | 7.39 | 0.06 |
| Example 11 | 5.97 | 6.28 | 7.42 | 0.06 |
| Comparative Example 3 | 1.16 | 6.33 | 6.60 | 12.00 |
| Comparative Example 4 | 4.06 | 6.50 | 7.01 | 5.86 |
| Comparative Example 5 | 15.11 | 6.14 | 7.41 | 0.05 |

Applied pressure: Values at 6 tons/cm$^2$.

Figure 5:
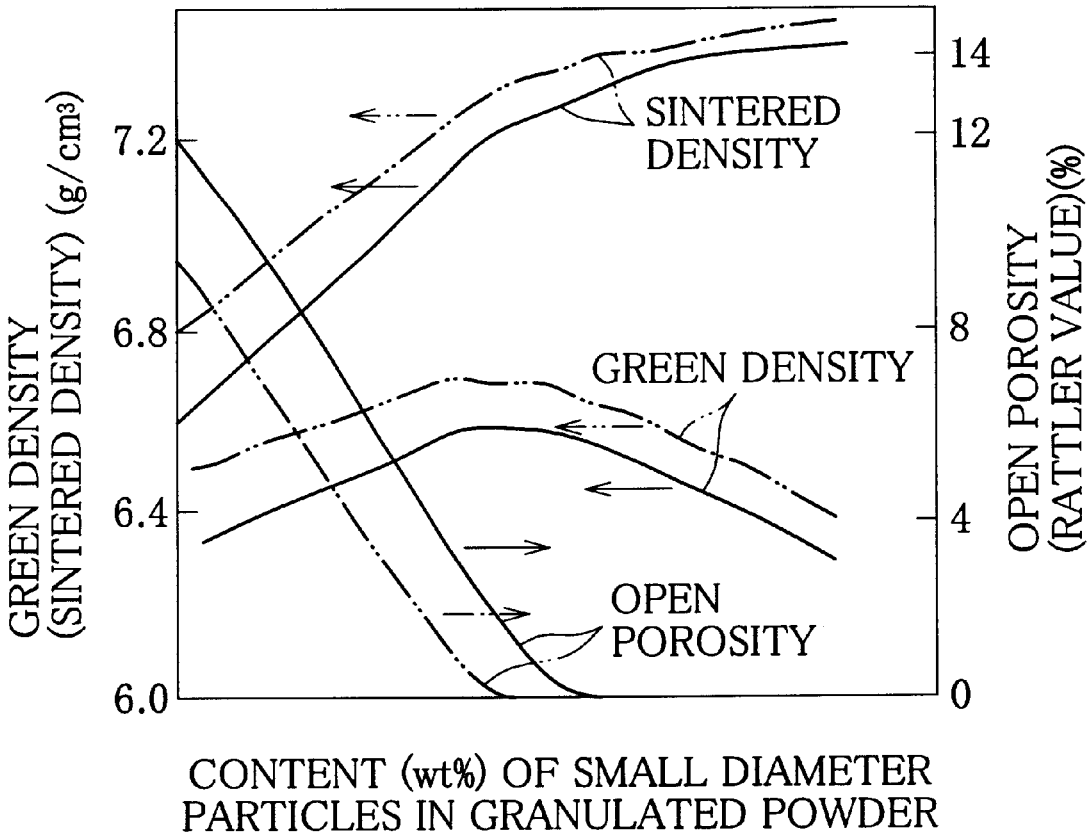
FIG. 5 is a graph in which the content of the small diameter particles in the granulated powder is taken as the abscissa, and the green density, rattler value, sintered density and open porosity of the sintered body are individually taken as the ordinate.

As is apparent from Table 8 and FIG. 5, in the granulated powders in Examples 7 to 11, the flow rate is high and the green density during the pressing of powder is excellent, and further, the sintered density during the sintering is excellent and the open porosity of the sintered body is small. It is noted that, the larger the content of the small diameter particles, the higher the sintered density, or the smaller the open porosity, and the green density has a maximum value relative to the content of the small diameter particles.

In each of Comparative Examples 3 and 4 wherein the content of the small diameter particles in the granulated powder is smaller than those in Examples 7 to 11, the sintered density of the sintered body is small and the open porosity is large. In addition, the green density is small, as compared to those in the Examples.

In Comparative Example 5 wherein the content of the small diameter particles in the granulated powder is larger than those in Examples 7 to 11, the sintered density and the open porosity of the sintered body are excellent, but the green density is poor. Therefore, it is necessary that the content of the small diameter particles in the granulated powder be 30 to 70% by weight.

As is apparent from the above description, the granulated powder for a high-density sintered body of the present invention is advantageous in that the flow rate of the granulated powder can be improved, since part of the small diameter particles is allowed to adhere to the surfaces of the large diameter particles to form skin particles having excellent flowability. Thus, the green strength is increased and the occurrence of crack or breakage is prevented, making it possible to improve the yield of the final products.

With this granulated powder containing the small diameter particles in a predetermined content, the sintered density (hermetic property) can be considerably improved, as compared to that of the conventional sintered powder. The effect is remarkable especially in austenite stainless steel which is inherently difficult to undergo sintering reaction and in ferrite stainless steel having a specific composition.

In addition, the green density is increased, so that the sintered density of the sintered body is further improved.

The high-density sintered body of the present invention has an open porosity of 5% or less and the open porosity value is thus considerably reduced, as compared to that of the conventional sintered body. Therefore, the sintered body is advantageous in that it has an excellent hermetic property, a high sintered density, and improved corrosion resistance, so that it can exhibit a corrosion resistance as high as the corrosion resistance that the material therefor inherently has.

What is claimed is:

1. A granulated powder for a high-density sintered body, comprising:

said granulated powder being obtained by granulation using a binder and a powder that includes small diameter particles comprised of stainless steel and having an average particle diameter of 1 to 20 μm and large diameter particles comprised of stainless steel and having an average particle diameter of 30 to 150 μm;

the content of said small diameter particles in said granulated powder being 30 to 70% by weight; and at least part of said small diameter particles adhering to surfaces of said large diameter particles.

2. The granulated powder for a high-density sintered body according to claim 1, wherein said binder has a lubricating property.

3. The granulated powder for a high-density sintered body according to claim 1, wherein said granulated powder has a flow rate of 15 sec/50 g or less as measured by the determination of flow rate employing an orifice diameter of 5 mm in accordance with JIS Z2504.

4. A method for producing a high-density sintered body, comprising the steps of:

producing a green compact using the granulated powder as set forth in claim 1; and sintering said green compact at a temperature of 1100 to 1350° C.

5. A high-density sintered body, which is a sintered body of the granulated powder as set forth in claim 1 and has an open porosity of 5% or less.

6. A method for producing a high-density sintered body, comprising the steps of:

producing a green compact using the granulated powder as set forth in claim 2; and sintering said green compact at a temperature of 1100 to 1350° C.

7. A method for producing a high-density sintered body, comprising the steps of:

producing a green compact using the granulated powder as set forth in claim 3; and sintering said green compact at a temperature of 1100 to 1350° C.

8. A high-density sintered body, which is a sintered body of the granulated powder as set forth in claim 2 and has an open porosity of 5% or less.

9. A high-density sintered body, which is a sintered body of the granulated powder as set forth in claim 3 and has an open porosity of 5% or less.

* * * * *